United States Patent [19]

Eliezer

[11] Patent Number: 4,791,255

[45] Date of Patent: Dec. 13, 1988

[54] TWIN BREAK TRANSFER SWITCH

[75] Inventor: Robert B. Eliezer, London, Ky.

[73] Assignee: Westinghouse Electric Corp., Pittsburgh, Pa.

[21] Appl. No.: 131,692

[22] Filed: Dec. 11, 1987

[51] Int. Cl.[4] ..... H01H 33/02

[52] U.S. Cl. ..... 200/144 R; 200/6 R; 200/6 BA; 200/155 R; 200/148 H; 307/64

[58] Field of Search ..... 200/148 H, 150 C, 144 R, 200/6 BA, 6 R, 155

[56] References Cited

U.S. PATENT DOCUMENTS

| | | | |
|---|---|---|---|
| 344,948 | 7/1986 | Solome . | |
| 346,020 | 7/1986 | Brown . | |
| 1,213,073 | 1/1917 | Carr . | |
| 1,361,937 | 12/1920 | Wagner et al. . | |
| 1,411,700 | 4/1922 | Holmes et al. . | |
| 1,574,548 | 2/1926 | Benjamin . | |
| 1,729,755 | 10/1929 | Williams . | |
| 1,777,844 | 10/1930 | Goldsmith . | |
| 2,399,044 | 4/1946 | Kyle | 200/67 |
| 2,456,256 | 12/1948 | Crowley | 171/97 |
| 2,466,072 | 4/1949 | Batchellor | 200/155 |
| 2,555,025 | 5/1951 | Cheek | 175/375 |
| 3,072,828 | 1/1963 | Goffaux | 317/61 |
| 3,167,620 | 1/1965 | Keyser et al. | 200/11 |
| 3,646,284 | 2/1972 | Bokshorn et al. | 200/148 H |
| 3,936,782 | 2/1976 | Moakler et al. | 335/161 |
| 4,021,678 | 5/1977 | Moakler et al. | 307/64 |
| 4,157,461 | 6/1979 | Wiktor | 200/18 |
| 4,189,649 | 2/1980 | Przywozny | 307/64 |
| 4,426,562 | 1/1984 | Kemeny | 200/150 C |
| 4,513,269 | 4/1985 | Miyamoto | 335/161 |
| 4,675,481 | 6/1987 | Markowski et al. | 200/148 H |

*Primary Examiner*—Robert S. Macon
*Attorney, Agent, or Firm*—L. P. Johns

[57] ABSTRACT

An electrical transfer switch for providing electrical power from either one of two sources of electrical power to a load, and characterized by at least a pair of spaced power contacts disposed on a base which contacts are electrically connected to different sources of power; a load contact on the base and interconnected with a load; an electrically conductive bridge pivotally supported intermediate the ends thereof on the base for rotation between different angular positions as power for the load is transferred from one power source to another power source.

4 Claims, 5 Drawing Sheets

TWIN BREAK TRANSFER SWITCH

BACKGROUND OF THE INVENTION

1. Field of the Invention

This invention relates to transfer switches and, more particularly, to rotatable electrical transfer switches for switching power from a primary to a secondary source.

2. Description of the Prior Art

Transfer switches are highly useful devices for switching power from a primary to a secondary source, such as from a utility to a mobile generator, during power outages. Conversely, transfer switches are employed to retransfer the load to the primary source when a primary source of power is available again, thereby disconnecting the secondary source.

For years, transfer switching systems have been used to facilitate emergency power for hospitals, subways, schools, airports, office buildings, and other commercial structures equipped with a secondary power source. Frequently, consumers also employ transfer switches to switch to an alternate power supply to avoid "peak time" utility charges. Some examples of power transfer switches are disclosed in U.S. Pat. Nos. 346,020; 549,810; 1,213,073; 3,072,828; 3,167,620; and 4,157,461.

Heretofore, many transfer switches have been unreliable for such reasons as overheating, complex construction, contact destruction due to arcing during normal operations, and susceptability to contact damage during short circuit condition. Thus, there has been a need for a transfer switch that obviates many of the unreliable circumstances.

SUMMARY OF THE INVENTION

The electrical transfer switch of this invention is of the type used to alternately deliver electrical power from either of two sources to a load, comprising a base, a pair of spaced power contacts disposed on the base, the first of which is electrically connected to one of the two sources of electrical power and the second of which is electrically connected with the other of the two sources of electrical power. First and second load contacts are disposed on the base and are interconnected electrically with each other and with the load with an electrically conductive bridge pivotally supported intermediate the ends thereof on the base for rotation between a first angular disposition and a second angular disposition, as power for said load is transferred from one power source to the other power source with the first angular disposition being one in which one portion of the conducting bridge is in a disposition of electrical contact with the first power contact, and the other portion of the conductive bridge being at a disposition of electrical contact with the first load contact and the second angular disposition being one in which the one portion of the conductive bridge is at a disposition of electrical contact with the second load contact, and the other portion of the conductive bridge is at a disposition of electrical contact with the second power contact. Means for rotating the electrically conductive bridge through the arc are provided and the conductive bridge is centrally, pivotally supported between the ends thereof on the base. The first and second load contacts and the pair of spaced power contacts are located on an arc circle, the center of which generally corresponds to the place where the electrically conductive bridge is pivotally supported on the base. A body of electrically insulating material is located between the pair of spaced power contacts in the plane of rotation of the electrically conductive bridge to increase the electrical insulation between the power contacts, and the electrical insulating material prevents continued rotation of the electrically conductive bridge in either rotational direction therebeyond.

The advantage of the transfer switch of this invention is that the path of the current is broken in two places with each operation, rather than in only one as in previous designs. This double break action greatly improves the switch's ability to interrupt current and results in vastly extended contact life. In addition, the double break configuration permits very large contact separations in a much smaller switch structure than would otherwise be possible. These large contact separations further improve contact performance and longevity over previous designs.

DESCRIPTION OF THE PREFERRED EMBODIMENT

Figure 2:
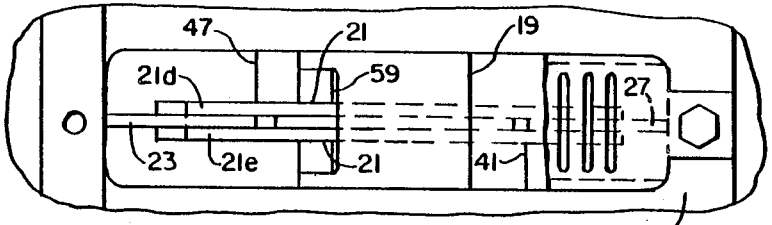
FIG. 2 is a fragmentary plan view taken on the line II—II of FIG. 1.
Figure 1:
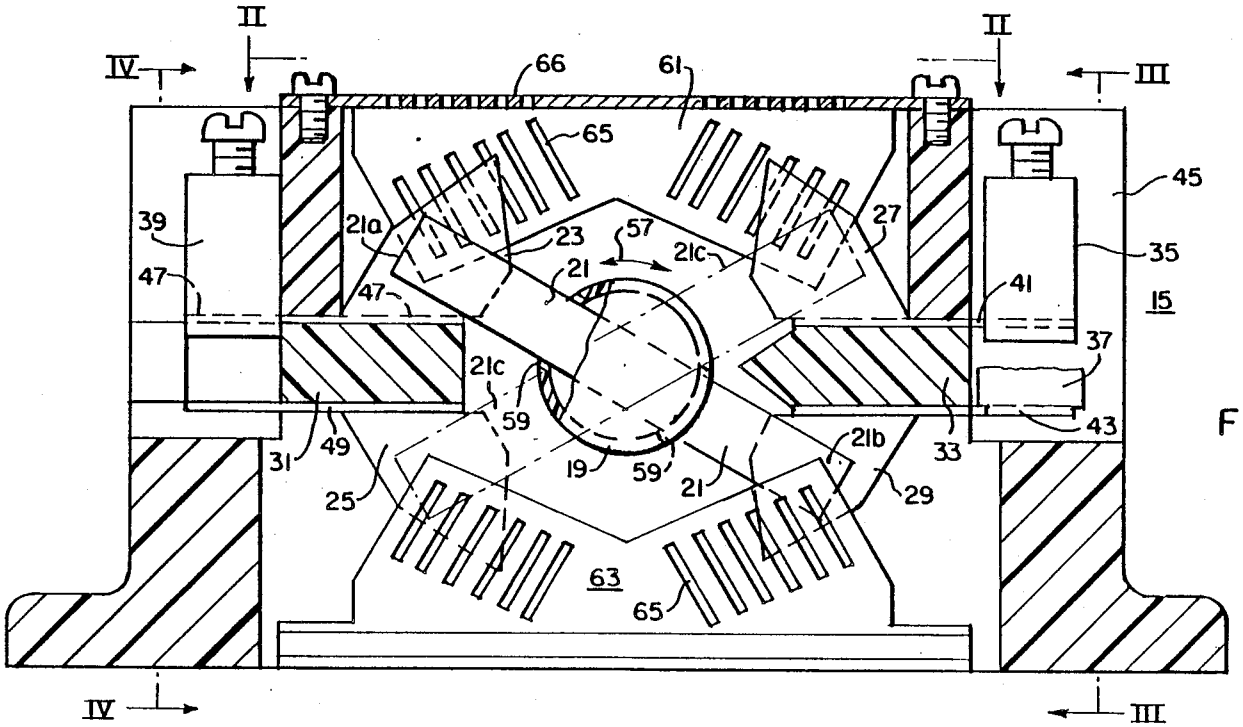
FIG. 1 is a sectional view through a transfer switch which is constructed according to the invention.

In FIG. 1 a rotary selector or transfer switch is generally indicated at 15 and it comprises an insulating housing 17. Although the switch 15 is adapted for multiphase operation, it is herein disclosed as a single phase unit.

The housing 17 comprises an inner chamber in which the operating parts of the switch are disposed those parts include a rotatable shaft 19, an electrically conductive bridge 21, and four stationary contacts 23, 25, 27, and 29. The stationary contacts 23, 25 are mounted on an insulating support member 31 and the stationary contacts 27, 29 are mounted on an insulating support member 33, which members are preferably part of the insulating housing 17.

Figure 3:
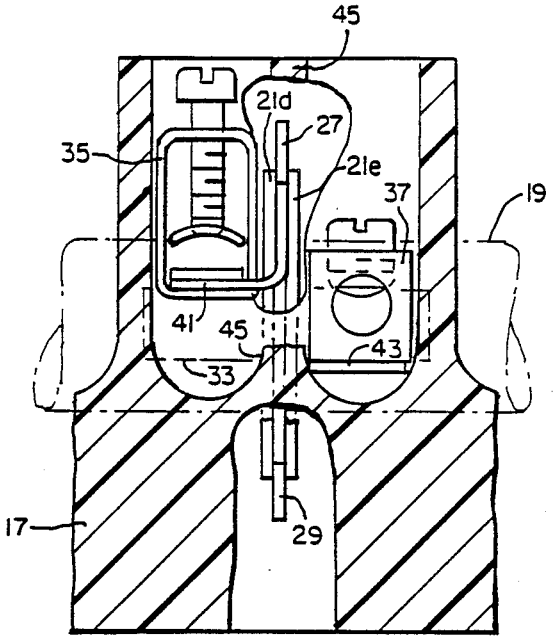
FIG. 3 is a vertical sectional view taken on the line III—III of FIG. 1.
Figure 4:
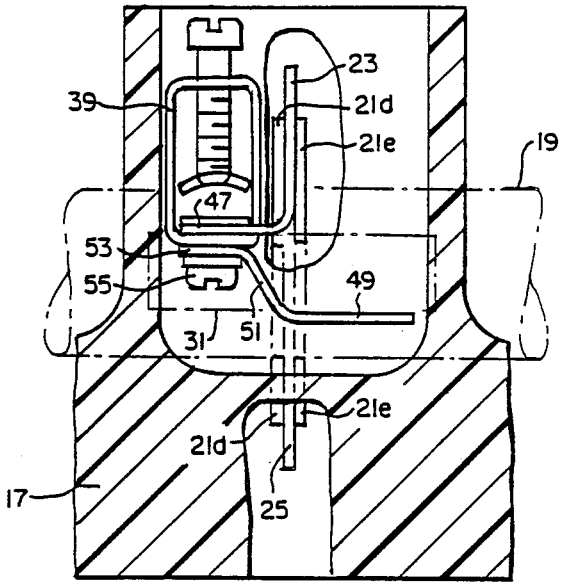
FIG. 4 is a vertical sectional view taken on the line IV—IV of FIG. 1.
Figure 5A:
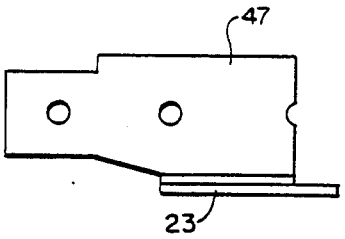
FIG. 5A is a plan view of one of the stationary contacts.
Figure 5B:
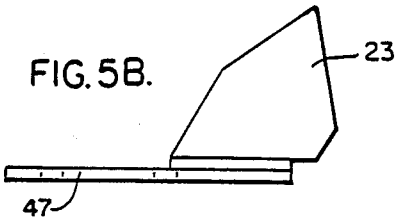
FIG. 5B is an elevational view of the contact shown in FIG. 5A.
Figure 5C:
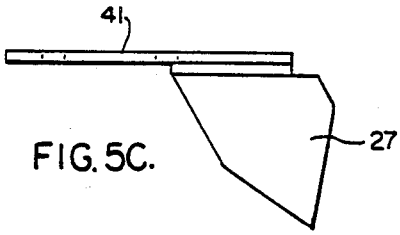
FIG. 5C is an elevational view of a stationary contact similar to that shown in FIGS. 5A and 5B, but having the contact flange extending in the opposite direction.
Figure 6A:
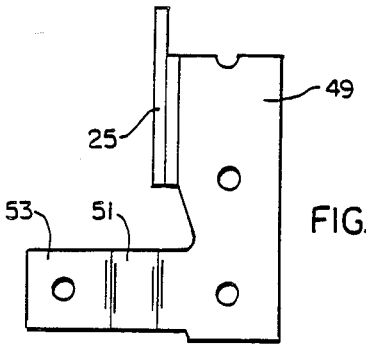
FIG. 6A is a plan view of another stationary contact.
Figure 6B:
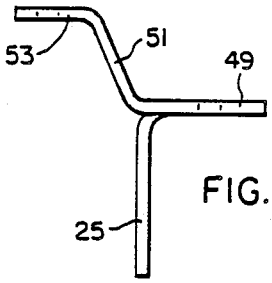
FIG. 6B is an elevational view of the stationary contact shown in FIG. 6A.

As shown in FIGS. 1 and 3 a pair of line terminals 35, 37 are provided for connecting one of two sources of power to a single load terminal 39 (FIGS. 1 and 4). One of the terminals 35, 37 is connected by conductors (not shown) to a common source of power, such as a utility, and the other terminal 35, 37 is connected to a conductor (not shown) to an alternate source or emergency power generator. The terminal 35 is electrically connected to a mounting base 41 of the stationary contact 27, and the line terminal 37 is electrically connected to a mounting base 43 of the contact 29. Inasmuch as the line terminals 35, 37 and the associated stationary contacts 27, 29 are of relatively high electrical potential, they are separated by the insulating support member 33 as well as a vane 45 of the insulating housing.

As shown in FIGS. 1 and 4 a single load terminal 39 is disposed at the end of the switch 15 opposite the line terminals 35, 37. The terminal 39 is electrically connected to a mounting base 47 of the stationary contact 23 (FIG. 4) which base is mounted on the support member 31. Likewise, the stationary contact 25, having a mounting base 49, is secured to the side of the support member 31 opposite the mounting base 47 (FIG. 4). In addition, the contact 25 includes an outturn conductor 51 having a connecting flange 53 which is secured to the load terminal 39 in good electrical contact by a screw 55. Accordingly, both stationary contacts 23, 25 are electrically connected to the load terminal 39.

As shown in FIG. 1 although the insulating support member 31 is disposed between the stationary contacts 23, 25, its purpose is to support the mounting basis 47, 49 of the contacts 23, 25, rather than to insulate the contacts from each other. Such insulation is not necessary in contrast with the required insulating support member 33 between the high potential contacts 27, 29.

In accordance with this invention the electically conductive bridge 21 rotates reversely as shown by the arrow 57 (FIG. 1). That is, the bridge 21 is rotated by the shaft 19, upon which the bridge is mounted, with the upper end portion 21*a* rotating between the stationary contacts 23, 27. Manifestly, the lower end portion 21*b* of the bridge rotates between the stationary contacts, 25, 29. It is noted that, unlike prior art structures having normal and emergency line terminals, the bridge end portion 21*b* does not rotate between the stationary contacts 27, 29, because of the presence of the insulating mounting member 33, but more particularly to avoid arcing between the contacts 27, 29 and the bridge 21 during rotation. An advantage of the construction of this invention is that the use of the insulating support member 33 instead of depending upon an insulating air gap between the contacts 27, 29, is a smaller switch structure than was feasible heretofore without the insulating support member 33.

The bridge 21 is rotated between the solid line position and the alternate position 21*c* (FIG. 1) by rotation of the shaft 19 which may be rotated either manually or by electromagnetic means. As shown in FIGS. 1, 3, and 4 the bridge 21 is preferably comprised of a pair of bridge blades 21*d*, 21*e* which extend through a pair of diagonally opposite holes 59 in the shaft 19 and, where they are retained in close-spaced relationship to provide good electrical contact between the blades 21*d*, 21*e* on opposite sides of the stationary contacts 23–29.

In order to minimize electric arcing between the bridge 21 and the several stationary contacts during the switching operation, a pair of arc extinguishers 61, 63 are provided. The arc extinguishers are U-shaped members having a plurality of slots 65, 67. The end portions of the bridge 21 move between the U legs of the channel shaped arc extinguisher 61, 63 during rotation of the bridge 21.

Figure 7A:
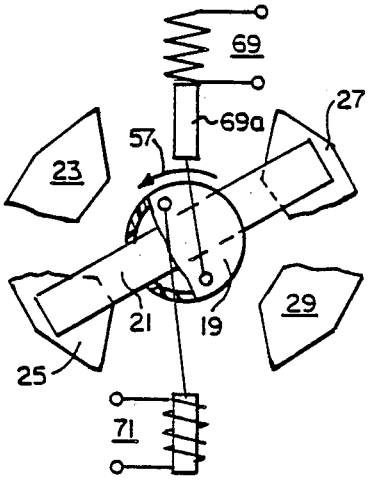
FIGS. 7A and 7B are schematic views of a reversing actuator showing the electrical contact bridge in opposite positions.
Figure 7B:
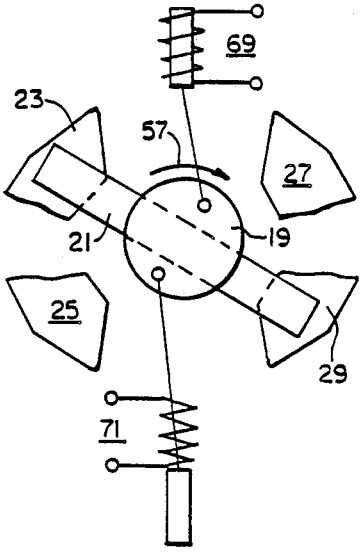

Although the switch 15 may be operated manually for rotating the shaft 19 and therefore the blade 21 between the respective stationary contacts 23, 29, the shaft is preferably rotated by electromagnetic means, such as shown schematically in FIGS. 7A, 7B. For that purpose a pair of solenoids 69, 71 may be provided. For example, actuation of the solenoid 69 causes the solenoid plunger 69*a* to be extended as shown and thereby rotate the shaft 19 to the position shown with the bridge 21 extending between the contacts 25, 27 (FIG. 7A), where the circuit through said contacts exist. Thereafter, deactivation of the solenoid 69 and activation of the solenoid 61 causes the shaft 19 to rotate counterclockwise as shown by the arrow 57 until the bridge 21 assumes the position between the contacts 27, 29 (FIG. 7B). To return the bridge 21 to the position shown in FIG. 7A, the shaft 19 is again rotated clockwise in the direction of the arrow 57 (FIG. 7B) by actuation of the solenoids 69 and deactivation of the solenoid 71.

As shown in FIGS. 8–12, the shaft 19 may be rotated by an actuating mechanism including a shaft 73, such as a solenoid plunger, and a pair of actuators 75, 77 which are pivotally mounted at 79 on the shaft 73. A coil spring 81 biases the left ends of the actuators together about the pivot 79 while pin 96 limits the angular separation of the actuators. A pair of drive pins 83, 85 are mounted on the end of the shaft 19. The shaft 73 is movable longitudinally in reverse directions as indicated by the arrow 73 by a solenoid and return spring. (not shown). The actuators 75, 77 include a notch 89, 91, respectively, and an elongated portion or finger 93, 95.

Figure 8:
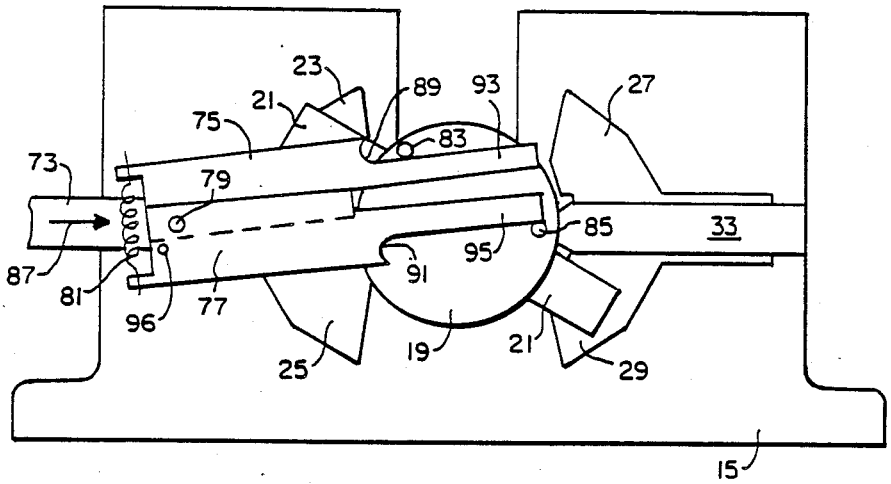
FIGS. 8–12 are elevational views of a specific solenoid reversing actuator, showing the several positions of the actuator 4 actuating the conductive bridge between the alternate operating positions.

In FIG. 8 when the bridge 21 extends between the stationary contacts 23, 29, the actuating mechanism may be retracted to the left with the finger 93 in contact with the pin 83 and the finger 95 in contact with the pin 85.

Figure 9:
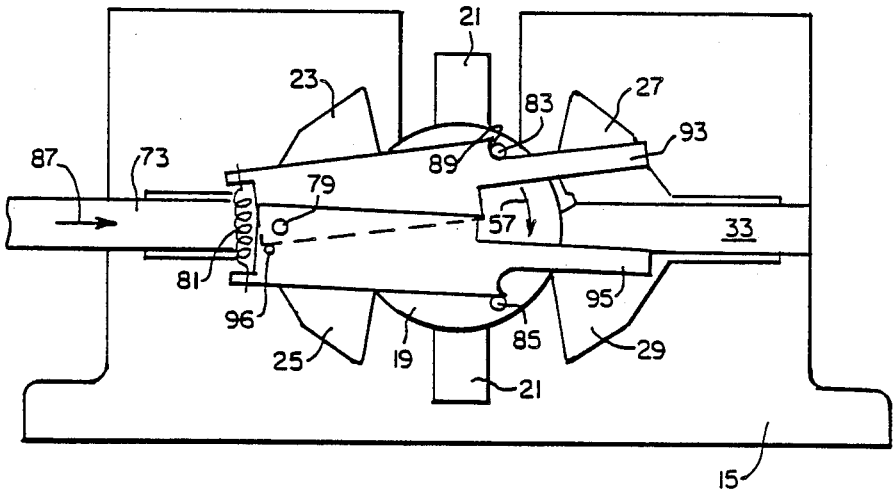

In FIG. 9 as the shaft 73 is actuated to the right by the solenoid, as indicated by the arrow 87, the notch 89 engages the pin 83 and rotates the shaft 19 with the bridge 21 to the intermediate position with the pin 85 rotating past the notch 91.

Figure 10:
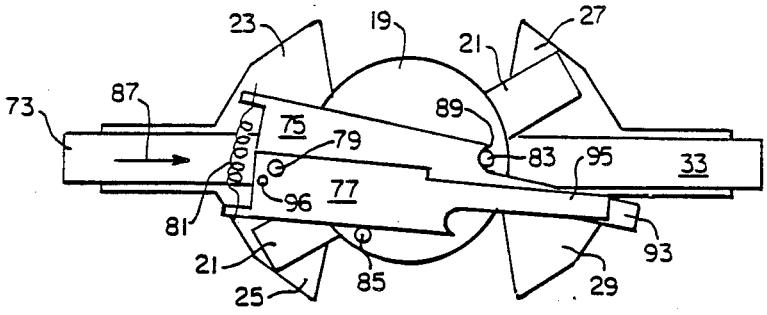

In FIG. 10 with continued movement of the shaft 73 to the right the shaft 19 continues to turn under the influence of the shoulder 89 on the pin 83 to bring the bridge 21 into engagement with the contacts 27, 25.

Figure 11:
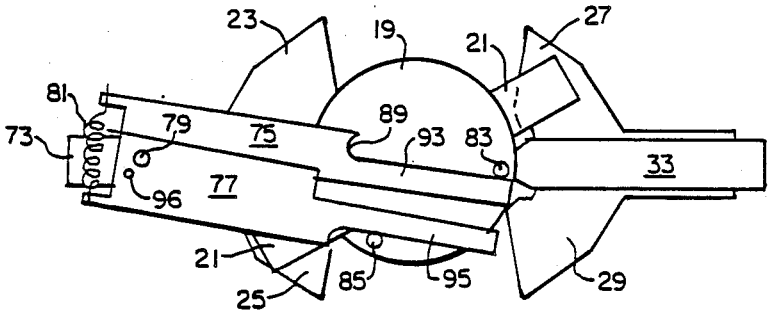
Figure 12:
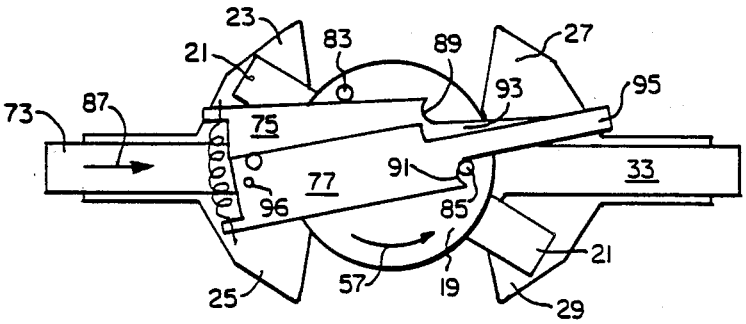

In FIG. 11 the shaft 73 is retracted by the return spring until the pin 85 is lodged against the finger 95 and on the right of the shoulder 91. The pin 83 is also lodged against the finger 93.

Subsequently, upon the next movement of the shaft 73 to the right, the notch 91 engages the pin 95 and rotates the shaft 19 counterclockwise and the bridge 21 to engage the stationary contacts 23, 29. The actuator then retracts to the position shown in FIG. 8 with the pin 83 in contact with the finger 93 and to the right of the notch 89, ready for subsequent engagement with the pin 83 as shown in FIG. 9.

In conclusion, the transfer switch of this invention provides a new and improved type of rotary selector switch which enables rapid conversion between different power sources in a reliable and effective manner.

What is claimed is:

1. An electrical transfer switch of the type used to alternatively deliver electrical power from either of two sources of electrical power to a load, comprising:

a base;

a pair of spaced power contacts disposed on said base the first of which is electrically connected to one of said two sources of electrical power and the second of which is electrically connected with the other of said two sources of electrical power;

first and second load contacts disposed on said base and interconnected electrically with each other and with said load;

an electrically conductive bridge pivotally supported intermediate the ends thereof on said base for being rotated between a first angular disposition and a second angular disposition as power for said load is transferred from said one power source to said other power source, said first angular disposition being one in which one portion of said conductive bridge is in a disposition of electrical contact with said first power contact and the other portion of said conductive bridge is at a disposition of electrical contact with said first load contact, said second angular disposition being one in which said one portion of said conductive bridge is at a disposition of electrical contact with said second load contact and said other portion of said conductive bridge is at a disposition of electrical contact with said second power contact; and said conductive bridge being mounted on a rotatable shaft, means for rotating said conductive bridge between said angular dispositions and including an actuating mechanism for reversely rotating the shaft, the shaft having a pair of arcuately spaced pins on one end thereof, the mechanism including a solenoid operable between thrust and retraction movements in response to a need to switch from one source of power to another, the mechanism also including a pair of actuators connected to the solenoid, each actuator being coupled with one of the pins for rotating the shaft in successive reverse directions, and each actuator having a surface engageable with a corresponding pin.

2. The combination as claimed in claim 1 in which said conductive bridge is centrally pivotally supported intermediate the ends thereof on said base.

3. The combination as claimed in claim 1 in which said first and second load contacts and said pair of spaced power contacts are disposed on an arc circle, the center of which generally corresponds to the place where said electrically conductive bridge is pivotally supported on said base.

4. The combination as claimed in claim 1 wherein electrically insulating material is disposed between said pair of spaced power contacts in the plane of rotation of said electrically conductive bridge to increase the electrical insulation between said power contacts, said electrical insulating material preventing continued rotation of said electrically conductive bridge in either rotational direction therebeyond.

* * * * *